US010727590B2

(12) United States Patent
Barrera et al.

(10) Patent No.: US 10,727,590 B2
(45) Date of Patent: Jul. 28, 2020

(54) ELECTRONIC DEVICES HAVING INTERIOR ANTENNAS

(71) Applicant: Apple Inc., Cupertino, CA (US)

(72) Inventors: Joel D. Barrera, San Jose, CA (US); Jerzy S. Guterman, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 152 days.

(21) Appl. No.: 15/980,511

(22) Filed: May 15, 2018

(65) Prior Publication Data

US 2019/0356051 A1 Nov. 21, 2019

(51) Int. Cl.

| | |
|---|---|
| ***H01Q 1/24*** | (2006.01) |
| ***H01Q 5/392*** | (2015.01) |
| ***H01Q 5/35*** | (2015.01) |
| ***H01Q 13/10*** | (2006.01) |
| ***H01Q 1/22*** | (2006.01) |

(52) U.S. Cl.
CPC ..... *H01Q 5/392* (2015.01); *H01Q 1/2266* (2013.01); *H01Q 5/35* (2015.01); *H01Q 13/106* (2013.01)

(58) Field of Classification Search
CPC ..... H01Q 5/392; H01Q 5/35; H01Q 13/106; H01Q 1/2266; H01Q 1/1221; H01Q 5/378; H01Q 3/24; H01Q 5/371; H01Q 9/0421; H01Q 1/44; H01Q 21/28
See application file for complete search history.

(56) References Cited

U.S. PATENT DOCUMENTS

| | | | | |
|---|---|---|---|---|
| 8,115,692 | B2 | 2/2012 | Nakano | |
| 9,077,066 | B1 * | 7/2015 | Lee | H01Q 9/0407 |
| 9,236,648 | B2 | 1/2016 | Guerman et al. | |
| 9,450,289 | B2 | 9/2016 | Guterman et al. | |
| 9,653,777 | B2 | 5/2017 | Guterman et al. | |
| 9,680,202 | B2 | 6/2017 | Irei et al. | |
| 9,865,914 | B2 | 1/2018 | Lim et al. | |

(Continued)

OTHER PUBLICATIONS

S.C Chen; Y.C., "Tsou,. Long-term evolution/wireless wide area network monopole exciter antenna for slim laptop with full metal cover" INSPEC Accession No. 15953857; DOI: 10.1049/el.2016.0327; ISSN: 0013-5194.

(Continued)

*Primary Examiner* — Dieu Hien T Duong
(74) *Attorney, Agent, or Firm* — Treyz Law Group, P.C.; Michael H. Lyons

(57) ABSTRACT

An electronic device may have an upper housing with a display and a lower housing with a keyboard. The upper housing may rotate between open and closed positions. The lower housing may include a first conductive wall separated from the upper housing by an upper slot and a second conductive wall separated from the upper housing by a lower slot. An antenna resonating element may be mounted within the lower housing and may convey signals in low and high frequency bands through the lower slot when the upper housing closed. The resonating element may be grounded to the second conductive wall and may be separated from a conductive cavity wall by at least one-sixteenth of a wavelength in the low frequency band. A parasitic element may be used to redirect signals in the low frequency band towards and through the upper slot when the upper housing open.

20 Claims, 11 Drawing Sheets

(56) References Cited

U.S. PATENT DOCUMENTS

| | | | | |
|---|---|---|---|---|
| 2004/0051670 | A1* | 3/2004 | Sato | G06F 1/1616 343/702 |
| 2017/0212554 | A1* | 7/2017 | Guterman | G06F 1/1616 |

OTHER PUBLICATIONS

Jo-Yen Nieh; Wei-Ming Syu et al., "Long-term evolution coupled-fed loop antenna installed in the hinge slot region of a laptop computer" [retrived from internet]. Retrieved from internet https://www.tandfonline.com/doi/full/10.1080/09205071.2018.1472044.

Jerzy S. Guterman et al., U.S. Appl. No. 15/008,139, filed Jan. 27, 2016.

* cited by examiner

ELECTRONIC DEVICES HAVING INTERIOR ANTENNAS

BACKGROUND

This relates generally to electronic devices and, more particularly, to wireless electronic devices with antennas.

Electronic devices often include antennas. For example, cellular telephones, computers, and other devices often contain antennas for supporting wireless communications.

It can be challenging to form electronic device antenna structures with desired attributes. In some wireless devices, the presence of conductive housing structures can influence antenna performance. Antenna performance may not be satisfactory if the housing structures are not configured properly and interfere with antenna operation. Device size can also affect performance. It can be difficult to achieve desired performance levels in a compact device, particularly when the compact device has conductive housing structures.

It would therefore be desirable to be able to provide improved wireless circuitry for electronic devices.

SUMMARY

An electronic device may have a metal housing. The metal housing may have an upper housing in which a component such as a display is mounted and a lower housing in which a component such as a keyboard is mounted. Hinges may be used to mount the upper housing to the lower housing for rotation about a rotational axis. The upper housing may rotate between an open position and a closed position.

The lower housing may have opposing first and second conductive walls. The first conductive wall may be separated from the upper housing by an upper slot. The second conductive wall may be separated from the upper housing by a lower slot. The electronic device may include wireless communications circuitry such as an antenna. The antenna may include an antenna resonating element mounted entirely within the lower housing and between the first and second conductive walls. The antenna resonating element may be formed on a dielectric substrate that is recessed into the lower housing away from the slots. In order to reduce the width of the lower slot, the second conductive wall may include a protruding portion that extends beyond an edge of the dielectric substrate.

The antenna may convey radio-frequency signals in a 5 GHz frequency band through the lower slot when the upper housing is in the closed position and through the upper and lower slots when the upper housing is in the open position. Conductive structures such as a sheet metal member may be formed in the lower housing and may short the first conductive wall to the second conductive wall. The conductive structures may form a cavity back for the antenna resonating element. The antenna resonating element may be located at a cavity depth from the conductive structures. The cavity depth may be between one-sixteenth and one-quarter of a wavelength corresponding to a frequency in a 2.4 GHz frequency band. The antenna resonating element may have a return path coupled to the second conductive wall. The antenna may be fed using an antenna feed with a ground antenna feed terminal coupled to the second conductive wall.

The antenna may include a parasitic antenna resonating element mounted to the first conductive wall. The parasitic antenna resonating element may be configured to resonate in the 2.4 GHz frequency band. The parasitic antenna resonating element may redirect radio-frequency signals in the 2.4 GHz frequency band from the lower slot towards and through the upper slot when the upper housing is in the open position. The antenna may thereby operate with satisfactory antenna efficiency across two or more frequency bands regardless of whether the upper housing is in the open or closed positions.

DETAILED DESCRIPTION

Figure 1:
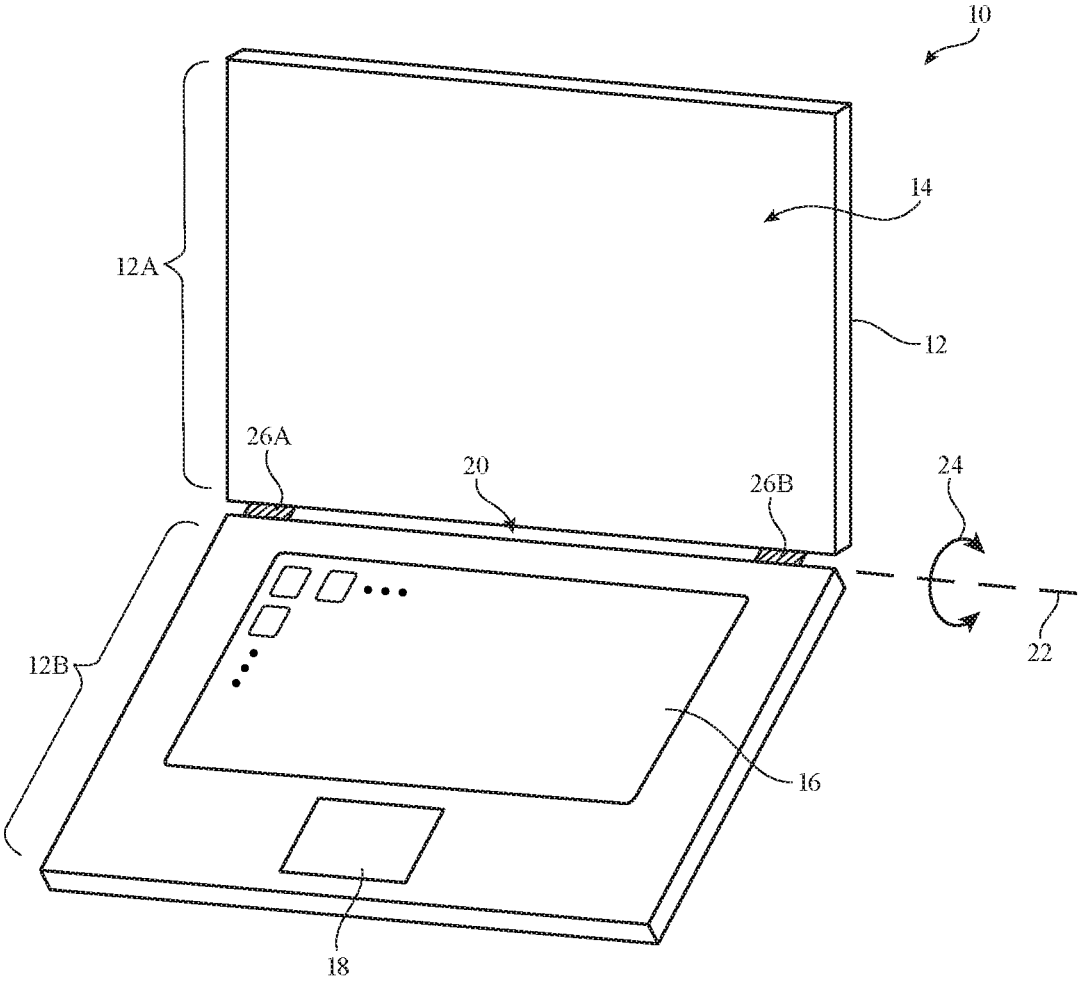
FIG. 1 is a perspective view of an illustrative electronic device such as a laptop computer in accordance with an embodiment.

An electronic device such as electronic device 10 of FIG. 1 may contain wireless circuitry. For example, electronic device 10 may contain wireless communications circuitry that operates in long-range communications bands such as cellular telephone bands and wireless circuitry that operates in short-range communications bands such as the 2.4 GHz Bluetooth® or other wireless personal area network (WPAN) bands and the 2.4 GHz and 5 GHz Wi-Fi® band or other wireless local area network (WLAN) bands (sometimes referred to as IEEE 802.11 bands or wireless local area network communications bands). Device 10 may also contain wireless communications circuitry for implementing near-field communications, communications at 60 GHz, light-based wireless communications, satellite navigation system communications, or other wireless communications.

Device 10 may be a handheld electronic device such as a cellular telephone, media player, gaming device, or other device, may be a laptop computer, tablet computer, or other portable computer, may be a desktop computer, may be a computer display, may be a display containing an embedded computer, may be a television or set top box, or may be other electronic equipment. Configurations in which device 10 has a rotatable lid as in a portable computer are sometimes described herein as an example. This is, however, merely illustrative. Device 10 may be any suitable electronic equipment.

As shown in the example of FIG. 1, device 10 may have a housing such as housing 12. Housing 12 may be formed from plastic, metal (e.g., aluminum), fiber composites such as carbon fiber, glass, ceramic, other materials, and combinations of these materials. Housing 12 or parts of housing 12 may be formed using a unibody construction in which housing structures are formed from an integrated piece of material. Multipart housing constructions may also be used in which housing 12 or parts of housing 12 are formed from frame structures, housing walls, and other components that are attached to each other using fasteners, adhesive, and other attachment mechanisms.

Some of the structures in housing 12 may be conductive. For example, metal parts of housing 12 such as metal housing walls may be conductive. Other parts of housing 12 may be formed from dielectric material such as plastic, glass, ceramic, non-conducting composites, etc. To ensure that antenna structures in device 10 function properly, care should be taken when placing the antenna structures relative to the conductive portions of housing 12.

If desired, portions of housing 12 may form part of the antenna structures for device 10. For example, conductive housing sidewalls may form all or part of an antenna ground. The antenna ground may include planar portions and/or portions that form one or more cavities for cavity-backed antennas. In addition to portions of housing 12, the cavities in the cavity-backed antennas may be formed from metal brackets, sheet metal members, and other internal metal structures, and/or metal traces on dielectric structures (e.g., plastic structures) in device 10. Metal traces may be formed on dielectric structures using molded interconnect device techniques (e.g., techniques for selectively plating metal traces onto regions of a plastic part that contains multiple shots of plastic with different affinities for metal), using laser direct structuring techniques (e.g., techniques in which laser light exposure is used to activate selective portions of a plastic structure for subsequent electroplating metal deposition operations), or using other metal trace deposition and patterning techniques.

As shown in FIG. 1, device 10 may have input-output devices such as track pad 18 and keyboard 16. Device 10 may also have components such as cameras, microphones, speakers, buttons, status indicator lights, buzzers, sensors, and other input-output devices. These devices may be used to gather input for device 10 and may be used to supply a user of device 10 with output. Connector ports in device 10 may receive mating connectors (e.g., an audio plug, a connector associated with a data cable such as a Universal Serial Bus cable, a data cable that handles video and audio data such as a cable that connects device 10 to a computer display, television, or other monitor, etc.).

Device 10 may include a display such a display 14. Display 14 may be a liquid crystal display (LCD), a plasma display, an organic light-emitting diode (OLED) display, an electrophoretic display, or a display implemented using other display technologies. A touch sensor may be incorporated into display 14 (i.e., display 14 may be a touch screen display) or display 14 may be insensitive to touch. Touch sensors for display 14 may be resistive touch sensors, capacitive touch sensors, acoustic touch sensors, light-based touch sensors, force sensors, or touch sensors implemented using other touch technologies.

Device 10 may have a one-piece housing or a multi-piece housing. As shown in FIG. 1, for example, electronic device 10 may be a device such as a portable computer or other device that has a two-part housing formed from an upper housing portion such as upper housing 12A and a lower housing portion such as lower housing 12B. Upper housing 12A may include display 14 and may sometimes be referred to as a display housing or lid. Lower housing 12B may sometimes be referred to as a base housing or main housing.

Housings 12A and 12B may be connected to each other using hinge structures located along the upper edge of lower housing 12B and the lower edge of upper housing 12A. For example, housings 12A and 12B may be coupled by hinges 26 such as hinges 26A and 26B that are located at opposing left and right sides of housing 12 along rotational axis 22 (sometimes referred to herein as hinge axis 22). A slot-shaped opening such as opening 20 may be formed between upper housing 12A and lower housing 12B and may be bordered on either end by hinges 26A and 26B. Opening 20 may sometimes be referred to herein as gap 20 or slot 20 between upper housing 12A and lower housing 12B. Hinges 26A and 26B, which may be formed from conductive structures such as metal structures, may allow upper housing 12A to rotate about axis 22 in directions 24 relative to lower housing 12B. Slot 20 extends along the rear edge of lower housing 12B parallel to axis 22. The lateral plane of upper housing (lid) 12A and the lateral plane of lower housing 12B may be separated by an angle that varies between 0° when the lid is closed to 90°, 140°, 160°, or more when the lid is fully opened.

Figure 2:
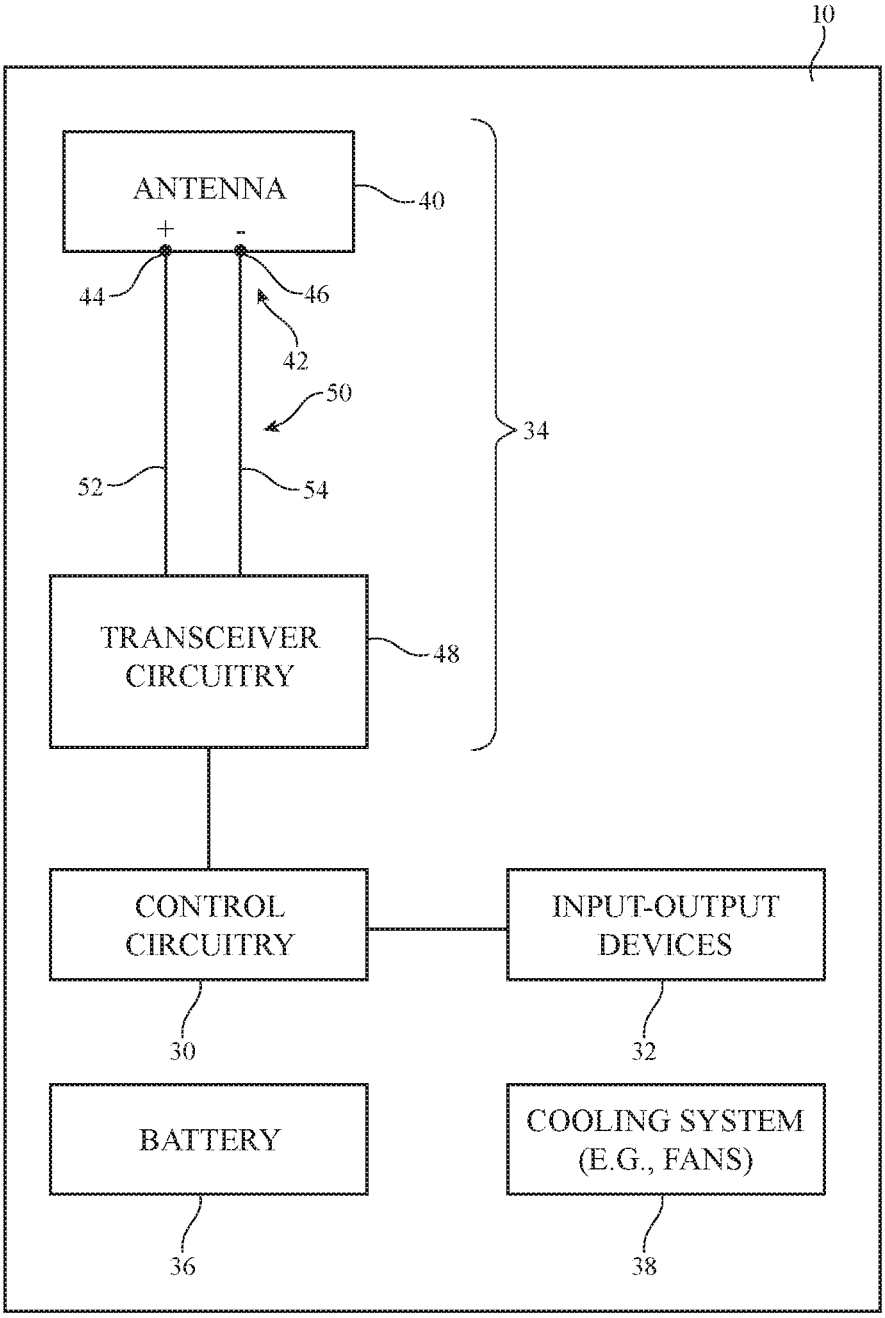
FIG. 2 is a schematic diagram of an illustrative electronic device with wireless circuitry in accordance with an embodiment.

A schematic diagram showing illustrative components that may be used in device 10 is shown in FIG. 2. As shown in FIG. 2, device 10 may include storage and processing circuitry such as control circuitry 30. Control circuitry 30 may include storage such as hard disk drive storage, non-volatile memory (e.g., flash memory or other electrically-programmable-read-only memory configured to form a solid state drive), volatile memory (e.g., static or dynamic random-access-memory), etc. Processing circuitry in circuitry 30 may be used to control the operation of device 10. This processing circuitry may be based on one or more microprocessors, microcontrollers, digital signal processors, baseband processor integrated circuits, application specific integrated circuits, etc.

Control circuitry 30 may be used to run software on device 10, such as internet browsing applications, voice-over-internet-protocol (VOIP) telephone call applications, email applications, media playback applications, operating system functions, etc. To support interactions with external equipment, control circuitry 30 may be used in implementing communications protocols. Communications protocols that may be implemented using control circuitry 30 include wireless local area network protocols (e.g., IEEE 802.11 protocols—sometimes referred to as WiFi®), protocols for other short-range wireless communications links such as the Bluetooth® protocol, and other wireless communications protocols.

Device 10 may include input-output devices 32. Input-output devices 32 may be used to allow data to be supplied to device 10 and to allow data to be provided from device 10 to external devices. Input-output devices 32 may include user interface devices, data port devices, and other input-output components. For example, input-output devices may include touch screens, displays without touch sensor capabilities, buttons, joysticks, scrolling wheels, touch pads, key pads, keyboards, microphones, cameras, speakers, status indicators, light sources, audio jacks and other audio port components, digital data port devices, light sensors, accelerometers, proximity sensors, and other sensors and input-output components.

Device 10 may include wireless communications circuitry 34 that allows control circuitry 30 of device 10 to communicate wirelessly with external equipment. The external equipment with which device 10 communicates wirelessly may be a computer, a cellular telephone, a watch, a router or other wireless local area network equipment, a wireless base station in a cellular telephone network, a display, or other electronic equipment. Wireless communications circuitry 34 may include radio-frequency (RF) transceiver circuitry 48 and one or more antennas such as antenna 40. Configurations in which device 10 contains a single antenna may sometimes be described herein as an example.

If desired, device 10 may be supplied with a battery such as battery 36. Control circuitry 30, input-output devices 32, wireless communications circuitry 34, and power management circuitry associated with battery 36 may produce heat during operation. To ensure that these components are cooled satisfactorily, device 10 may be provided with a cooling system such as cooling system 38. Cooling system 38, which may sometimes be referred to as a ventilation system, may include one or more fans and other equipment for removing heat from the components of device 10. Cooling system 38 may include structures that form airflow ports (e.g., openings in ventilation port structures located along slot 20 of FIG. 1 or other portions of device 10 through which cool air may be drawn by one or more cooling fans and through which air that has been warmed from heat produced by internal components may be expelled). Airflow ports, which may sometimes be referred to as cooling ports, ventilation ports, air exhaust and entrance ports, etc., may be formed from arrays of openings in plastic ventilation port structures or other structures associated with cooling system 38.

Radio-frequency transceiver circuitry 48 and antenna(s) 40 may be used to handle one or more radio-frequency communications bands. For example, circuitry 48 may include wireless local area network transceiver circuitry that may handle a 2.4 GHz band for WiFi® and/or Bluetooth® communications and, if desired, may include 5 GHz transceiver circuitry (e.g., for WiFi®). If desired, transceiver circuitry 48 and antenna(s) 40 may handle communications in other bands (e.g., cellular telephone bands, near field communications bands, bands at millimeter wave frequencies, etc.).

Antenna(s) 40 in wireless communications circuitry 34 may be formed using any suitable types of antenna. For example, an antenna for device 10 may include a resonating element that is formed from a loop antenna structure, a patch antenna structure, an inverted-F antenna structure, a slot antenna structure, a planar inverted-F antenna structure, a helical antenna structure, a hybrid of these structures, etc. If desired, device 10 may include cavity-backed antennas (e.g., cavity-backed inverted-F antennas in which a conductive cavity backs an inverted-F antenna resonating element and serves to optimize the gain and directionality of the inverted-F antenna resonating element, cavity-backed slot antennas, cavity-backed monopole antennas, cavity-backed loop antennas, etc.). Control circuitry 30, input-output devices 32, wireless communications circuitry 34, and other components of device 10 may be mounted in device housing 12 (FIG. 1).

As shown in FIG. 2, transceiver circuitry 48 in wireless communications circuitry 34 may be coupled to antennas such as antenna 40 using paths such as transmission line path 50 (sometimes referred to herein as radio-frequency transmission line 50). Transmission line paths in device 10 such as transmission line 50 may include coaxial cables, microstrip transmission lines, stripline transmission lines, edge-coupled microstrip transmission lines, edge-coupled stripline transmission lines, waveguide transmission lines (e.g., coplanar waveguides, grounded coplanar waveguides, etc.), transmission lines formed from combinations of transmission lines of these types, etc.

Transmission line paths in device 10 such as transmission line 50 may be integrated into rigid and/or flexible printed circuit boards if desired. In one suitable arrangement, transmission line paths in device 10 may include transmission line conductors (e.g., signal and/or ground conductors) that are integrated within multilayer laminated structures (e.g., layers of a conductive material such as copper and a dielectric material such as a resin that are laminated together without intervening adhesive) that may be folded or bent in multiple dimensions (e.g., two or three dimensions) and that maintain a bent or folded shape after bending (e.g., the multilayer laminated structures may be folded into a particular three-dimensional shape to route around other device components and may be rigid enough to hold its shape after folding without being held in place by stiffeners or other structures). All of the multiple layers of the laminated structures may be batch laminated together (e.g., in a single pressing process) without adhesive (e.g., as opposed to performing multiple pressing processes to laminate multiple layers together with adhesive). Filter circuitry, switching circuitry, impedance matching circuitry, and other circuitry may be interposed within the transmission lines, if desired.

Transmission line 50 in device 10 may be coupled to antenna feed 42 of antenna 40. Antenna 40 of FIG. 2 may, for example, form an inverted-F antenna, a planar inverted-F antenna, a slot antenna, a hybrid inverted-F slot antenna or other antenna having an antenna feed such as antenna feed 42 with a positive antenna feed terminal such as positive antenna feed terminal 44 and a ground antenna feed terminal such as ground antenna feed terminal 46. Transmission line 50 may include a positive transmission line conductor 52 (sometimes referred to herein as signal conductor 52) and a ground transmission line conductor 54 (sometimes referred to herein as ground conductor 54). Signal conductor 52 may be coupled to positive antenna feed terminal 44 and ground conductor 54 may be coupled to ground antenna feed terminal 46. Other types of antenna feed arrangements may be used (e.g., indirect feed arrangements, feed arrangements in which antenna 40 is fed using multiple feeds, etc.) and multiple antennas 40 may be provided in device 10, if desired. The feeding configuration of FIG. 2 is merely illustrative.

Filter circuitry, switching circuitry, impedance matching circuitry, and other circuitry may be interposed within transmission line 50, in or between parts of antenna 40, or in other portions of wireless communications circuitry 34, if desired. Control circuitry 30 may be coupled to transceiver circuitry 48 and input-output devices 32. During operation, input-output devices 32 may supply output from device 10 and may receive input from sources that are external to device 10. Control circuitry 30 may use wireless communications circuitry 34 to transmit and receive wireless signals.

Figure 3:
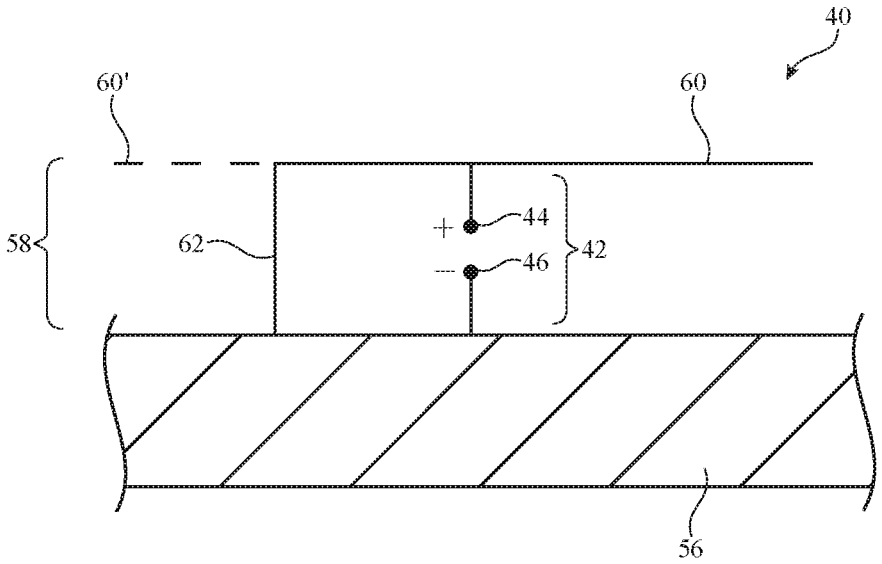
FIG. 3 is a diagram of an illustrative inverted-F antenna in accordance with an embodiment.

FIG. 3 is a schematic diagram of an illustrative antenna for device 10. In the example of FIG. 3, antenna 40 is an inverted-F antenna having inverted-F antenna resonating element 58 and antenna ground 56 (sometimes referred to herein as ground plane 56, ground structures 56, antenna ground structures 56, or ground 56). Antenna resonating element 58 (sometimes referred to herein as antenna radiating element 58, resonating element 58, or radiating element 58) may have a main resonating element arm such as arm 60. If desired, antenna resonating element 58 may have multiple branches (e.g., a first branch formed from arm 60, a second branch formed from arm 60', etc.). The lengths of each of the branches of antenna resonating element 58 may be selected to support communications band resonances at desired frequencies (e.g., a high band resonance may be supported using a shorter branch such as arm 60' and a low band resonance may be supported using a longer branch such as arm 60). Antenna resonances may also be produced from resonating element harmonics and/or using parasitic antenna resonating elements.

As shown in FIG. 3, antenna resonating element 58 (e.g., arm 60) may be coupled to antenna ground 56 by return path 62. Antenna feed 42 may be coupled between arm 60 and antenna ground 56 in parallel with return path 62. Positive antenna feed terminal 44 may be coupled to arm 60. Ground antenna feed terminal 46 may be coupled to antenna ground 56. Antenna ground 56 may be formed from metal portions of housing 12 (e.g., portions of lower housing 12B of FIG. 1), metal traces on a printed circuit or other carrier, internal metal bracket members, sheet metal members, metal foil, and/or other conductive structures in device 10.

Figure 4:
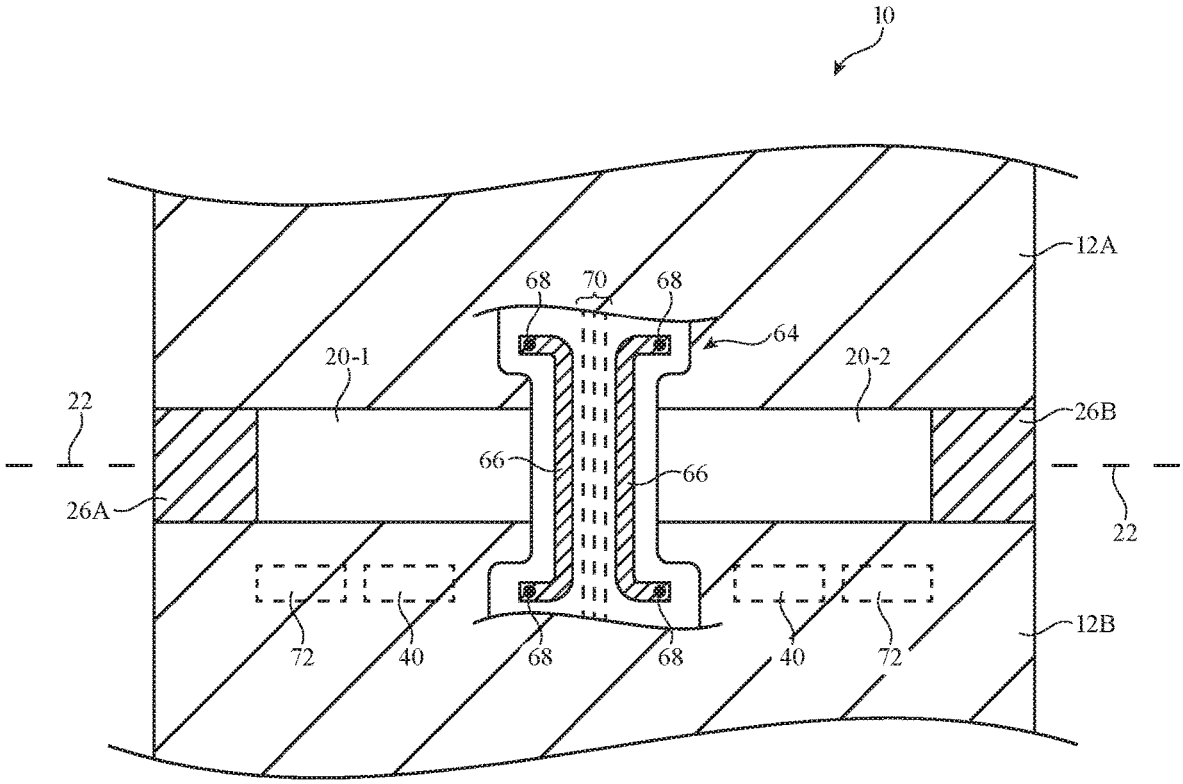
FIG. 4 is a diagram showing hinge and flexible printed circuit structures bridging a gap between upper and lower housings in a laptop computer of the type shown in FIG. 1 in accordance with an embodiment.

Metal traces on one or more flexible printed circuits may bisect slot 20 of FIG. 1. Consider, for example, the illustrative configuration of device 10 that is shown in FIG. 4. In the example of FIG. 4, upper housing 12A is separated from lower housing 12B by air-filled slot 20. Hinges 26A and 26B may be coupled between housings 12A and 12B along the respective left and right edges of device 10. One or more flexible printed circuits such as flexible printed circuit 64 may bisect slot 20 along the length of slot 20, thereby creating two slots (i.e., two separate slot-shaped portions of slot 20) such as slots 20-1 and 20-2. Flexible printed circuit 60 may contain one or more sheets of flexible dielectric substrate material such as a layer of polyimide or a sheet of other flexible polymers.

Flexible printed circuit 60 may include signal lines 70 for routing display signals (i.e., data signals associated with displaying images on display 14 of FIG. 1) and other signals (e.g., camera signals, backlight signals, power signals, touch sensor signals, etc.) between upper housing 12A and lower housing 12B. Ground traces 66 may be provided on the outer edges of flexible printed circuit 64 (i.e., in flexible printed circuit 64, signal lines 70 may be flanked on opposing sides by ground traces 66). Ground traces 66 may be formed from copper or other metal and may have any suitable widths (e.g., 1 mm to 3 mm, less than 1 mm, more than 1 mm, etc.). Ground traces 66 may be shorted to metal housings 12A and 12B using screws, other fasteners, welds, conductive adhesive, solder, or other conductive coupling mechanism (see, e.g., conductive ground connections 68).

With this type of arrangement, slots (openings) 20-1 and 20-2 may be surrounded by metal. For example, slots 20-1 and 20-2 may be surrounded by metal portions of upper housing 12A and lower housing 12B on their top and bottom edges. Hinges 26A and 26B and ground traces 66 may also be formed from metal and may help define the shapes of slots 20-1 and 20-2. As shown in FIG. 4, slot 20-1 may have a left edge formed by hinge 26A and an opposing right edge formed from the ground traces on flexible printed circuit 64. Slot 20-2 may have a left edge formed from flexible printed circuit 64 and an opposing right edge formed from hinge 26-B. The example of FIG. 4 in which one flexible printed circuit divides slot 20 into two separate slots is merely illustrative. If desired, two or more flexible printed circuits may divide slot 20 into three or more separate slots. Two or more separate flexible printed circuits may divide slot 20 into two separate slots 20-1 and 20-2 if desired (e.g., two or more separate flexible printed circuits may be interposed between slots 20-1 and 20-2).

During wireless operation of device 10, slots 20-1 and 20-2 may serve as antenna apertures for respective electrically isolated antennas 40 in lower housing 12B of device 10. For example, a first antenna 40 may be mounted within lower housing 12B and aligned with slot 20-1 and a second antenna 40 may be mounted within lower housing 12B and aligned with slot 20-2. Conductive structures in lower housing 12B may form cavity structures for each of the antennas 40 (e.g., cavity-shaped ground structures or other ground structures that form part of antenna ground 56 of FIG. 3). By aligning antennas 40 with separate slots between lower housing 12B and upper housing 12A in device 10, the antennas may exhibit sufficient electrical isolation from each other (e.g., such that the antennas may be used to form a multiple-input-multiple-output (MIMO) antenna array at 2.4 GHz and/or 5 GHz and/or other suitable frequencies for wireless local area network communications, etc.).

Device 10 may have ventilation port structures such as ventilation port structures 72 mounted along the rear edge of lower housing 12B or elsewhere in device 10. Ventilation port structures 72 may have arrays of openings that form ventilation ports. Fans in cooling system 38 (FIG. 2) may be used to draw air into lower housing 12B through the openings and may be used to exhaust air that has been warmed by the circuitry in lower housing 12B through the openings. Separate ventilation port structures 72 may be aligned with slots 20-1 and 20-2 if desired. For example, a first ventilation port structure 72 may be interposed between the antenna 40 aligned with slot 20-1 and hinge 26A whereas a second ventilation port structure 72 is interposed between the antenna 40 aligned with slot 20-2 and hinge 26B. In another suitable arrangement, ventilation port structures 72 may be interposed between antennas 40 and flexible printed circuit 64. If desired, multiple antennas 40 may be aligned with slot 20-1 and/or multiple antennas 40 may be aligned with slot 20-2.

Figure 5:
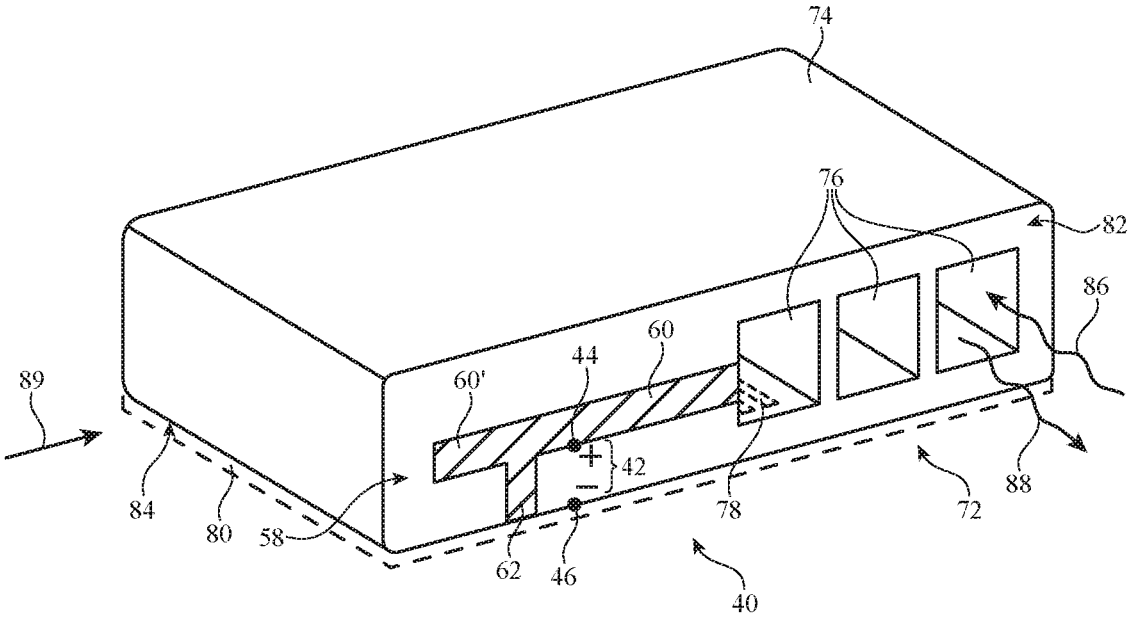
FIG. 5 is a perspective view of a dielectric substrate having ventilation port openings and antenna resonating element in accordance with an embodiment.

If desired, a given antenna 40 and a given ventilation port structure 72 may be formed on a common (shared) substrate mounted within lower housing 12B. FIG. 5 is a perspective view showing how antenna 40 and ventilation port structure 72 may be formed on the same dielectric support structure such as substrate 74. Substrate 74 may be formed dielectric material such as plastic, foam, ceramic, glass, rubber, or any other desired dielectric materials. Substrate 74 may be mounted along the rear edge of lower housing 12B adjacent to slot 20-1 or slot 20-2 of FIG. 4. Substrate 74 may be mounted within the interior of lower housing 12B (e.g., between a conductive upper wall and a conductive lower wall of lower housing 12B, where keyboard 16 and track pad 18 of FIG. 1 are formed in the conductive upper wall of lower housing 12B).

As shown in FIG. 5, antenna resonating element 58 (e.g., arm 60, arm 60', and return path 62) for antenna 40 may be formed from conductive material on front surface 82 of substrate 74. As an example, antenna resonating element 58 may be formed from conductive traces on front surface 82 of substrate 74. Return path 62 of antenna resonating element 58 may extend to bottom surface 84 of substrate 74.

If desired, a conductive layer such as conductive layer 80 may be formed on bottom surface 84 of substrate 74. Conductive layer 80 may be formed from conductive brackets, conductive gaskets, conductive springs, conductive fasteners, conductive screws, conductive pins, a sheet metal layer, conductive adhesive, solder, welds, conductive foam, conductive traces, metal foil, combinations of these, and/or any other desired conductive material on bottom surface 84 of substrate 74. While referred to herein as conductive layer 80, the conductive material in conductive layer 80 may have a substantially planar shape, may have planar and non-planar portions, or may have a non-planar shape, for example. Positive antenna feed terminal 44 of antenna feed 42 may be coupled to arm 60 and ground antenna feed terminal 46 of antenna feed 42 may be coupled to conductive layer 80. Return path 62 may be coupled to (e.g., galvanically connected to) conductive layer 80 such that conductive layer 80 forms part of antenna ground 56 (FIG. 3) for antenna 40. Return path 62 may be soldered or welded to conductive layer 80, may be coupled to conductive layer 80 using conductive interconnect structures, or may be formed from an integral portion of conductive layer 80 (e.g., antenna resonating element 58 and conductive layer 80 may be formed from a single continuous conductor if desired).

Conductive layer 80 may be coupled to (e.g., shorted to) the conductive lower wall of lower housing 12B. For example, when substrate 74 is mounted within lower housing 12B (FIGS. 1 and 4), conductive layer 80 may be in contact with the conductive lower wall of lower housing 12 or may be coupled to the conductive lower wall using any desired conductive interconnect structures (e.g., solder, welds, conductive adhesive, conductive clips, conductive foam, conductive brackets, conductive screws, etc.). In this way, conductive layer 80 and the conductive lower wall of lower housing 12B may both form a portion of antenna ground 56 for antenna 40 (FIG. 3).

This is merely illustrative and, if desired, conductive layer 80 may be omitted. In these scenarios, ground antenna feed terminal 46 and return path 62 may be coupled directly to the conductive lower wall of lower housing 12B or to conductive material such as a sheet metal layer located between bottom surface 84 of substrate 74 and the conductive lower wall (e.g., using conductive interconnect structures such as solder, welds, conductive adhesive, conductive wire, conductive foam, conductive brackets, conductive screws, combinations of these, etc.). Portions of the feed path for antenna feed 42 and portions of return path 62 may be formed using vias that pass through substrate 74 if desired. Metal traces used in forming conductive layer 80 and/or antenna resonating element 58 may be formed on dielectric substrate 74 using molded interconnect device techniques (e.g., techniques for selectively plating metal traces onto regions of a plastic part that contains multiple shots of plastic with different affinities for metal), using laser direct structuring techniques (e.g., techniques in which laser light exposure is used to activate selective portions of a plastic structure for subsequent electroplating metal deposition operations), or using other metal trace deposition and patterning techniques.

As shown in FIG. 5, ventilation port structure 72 may have ventilation port openings 76 in substrate 74. Openings 76 may extend from front surface 82 of substrate 74 to the opposing rear surface of substrate 74 or to any other desired surface of substrate 74. Openings 76 may be used to allow air to enter the interior of lower housing 12B, as shown by arrow 86, and/or to exit the interior of lower housing 12B, as shown by arrow 88. Substrate 74 may include any desired number of openings 76 arranged in any desired pattern (e.g., one or two-dimensional arrays of 6-20 openings, more than four openings, fewer than 30 openings, etc.). Each array of openings 76 may form a different respective ventilation port in device 10. For example, a first array of openings 76 on a substrate 74 aligned with slot 20-1 of FIG. 4 may form first ventilation port whereas a second array of openings 76 on a substrate 74 aligned with slot 20-2 may form a second ventilation port. If desired, the first ventilation port may be used to allow air to enter the interior of lower housing 12B whereas the second ventilation port is used to allow air to exit the interior of lower housing 12B.

The example of FIG. 5 in which antenna 40 and openings 76 are formed on separate portions of front surface 82 is merely illustrative. If desired, arm 60 of antenna resonating element 60 may extend along front surface 82 between two or more openings 76 (e.g., between two horizontal rows of openings 76). If desired, arm 60 may include a portion 78 that extends into one or more openings 76. Portion 78 of arm 60 may serve to increase the length of arm 60 (e.g., to tune a frequency response of antenna 40). Portions of arm 60 may be formed from conductive vias in substrate 74 if desired.

Antenna resonating element arms 60 and 60' may allow antenna 60 to support radio-frequency communications in multiple frequency bands. The length of antenna resonating element arm 60, arm 60', and return path 62 may be selected so that antenna 40 radiates with a satisfactory antenna efficiency within one or more desired frequency bands of interest. For example, the length from the tip of arm 60 through return path 62 may be approximately equal to one quarter of an effective wavelength at a first desired operating frequency for antenna 40 (e.g., a frequency in the 2.4 GHz WLAN or WPAN band). The length from the tip of arm 60' through return path 62 may be approximately equal to one quarter of an effective wavelength at a second desired operating frequency for antenna 40 (e.g., a frequency in the 5.0 GHz WLAN band). These effective wavelengths may be offset from free space wavelengths by a factor associated with the dielectric constant of substrate 74. Harmonic modes of arm 60 and/or arm 60' may also support communications in these or additional frequency bands if desired.

The example of FIG. 5 is merely illustrative. If desired, antenna resonating element 58 may have additional arms or branches for covering additional bands. Additional antennas 40 may be formed on substrate 74. Substrate 74 may have any desired shape and any desired number of sides (e.g., any desired shape having one or more curved and/or straight sides). Antenna resonating element 58 may have straight and/or curved edges and may have any desired shape (e.g., any desired shape following one or more curved and/or straight paths). Other types of antennas may be used if desired. Antenna resonating element 58 may extend onto two or more sides of substrate 74 if desired. Substrate 74 may be hollow and may include one or more interior cavities. In these scenarios, antenna resonating element 58 may be formed on surfaces of the interior cavities if desired. Ventilation port structure 72 may be omitted from substrate 74 in another suitable arrangement (e.g., antenna 40 may be formed on a dedicated antenna substrate or may be formed on a substrate that supports other device components).

Figure 6:
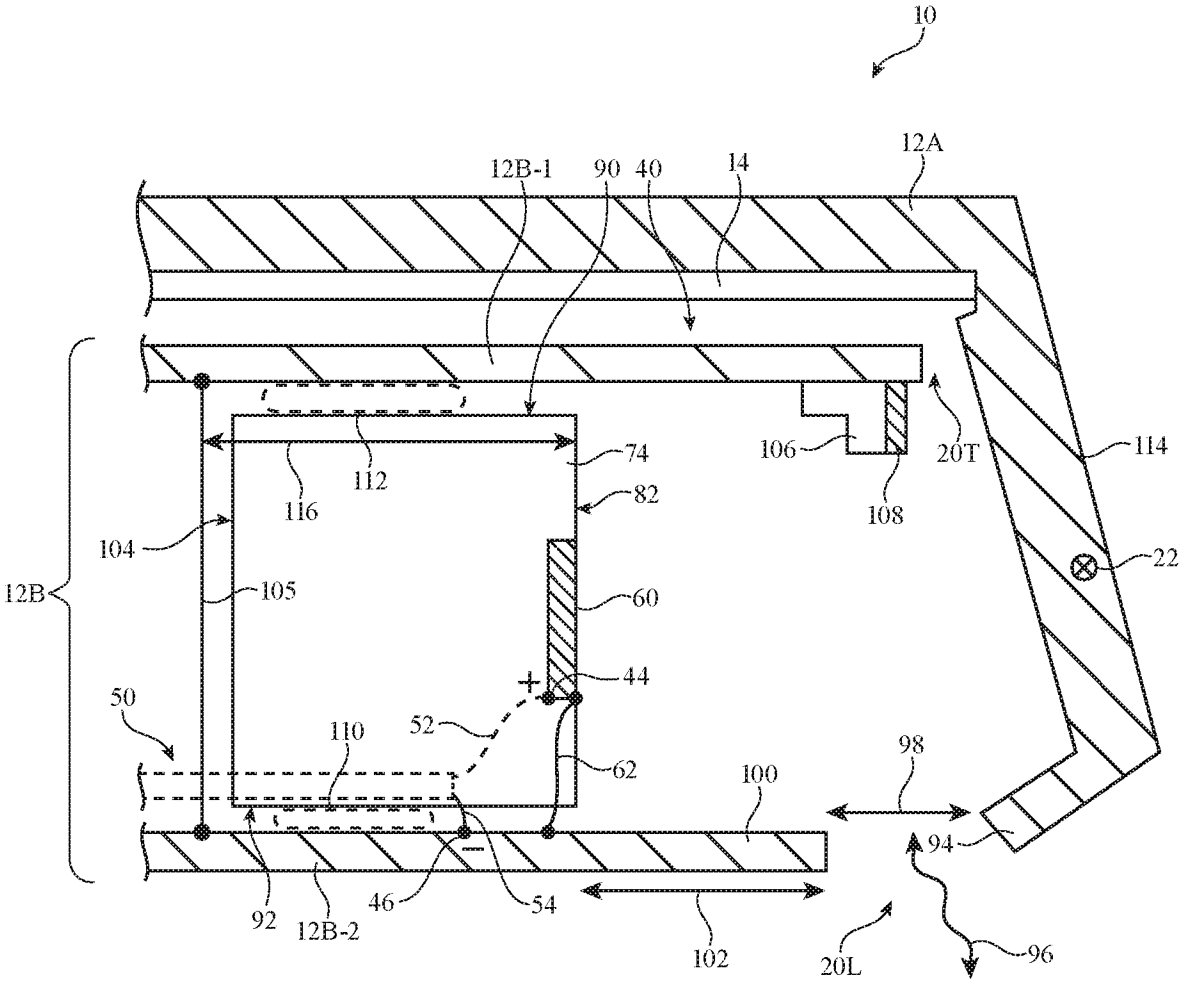
FIG. 6 is a cross-sectional side view of an illustrative rear portion of the lower housing of a laptop computer showing how antenna structures may operate at multiple frequencies through a slot between the lower housing and an upper housing in accordance with an embodiment.
Figure 7:
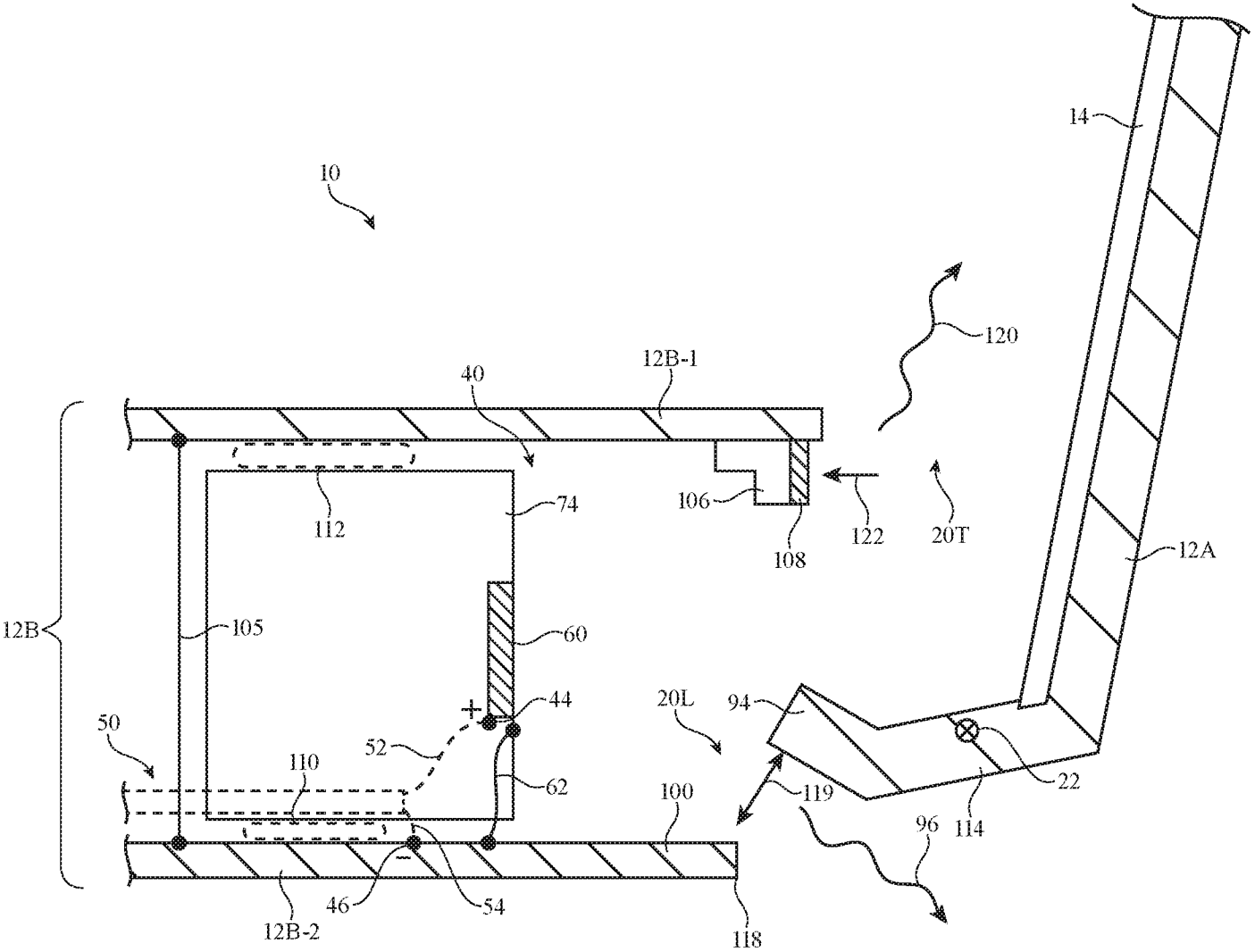
FIG. 7 is a cross-sectional side view of an illustrative rear portion of the lower housing of a laptop computer showing how antenna structures may operate at multiple frequencies through multiple slots between the lower housing and an upper housing in accordance with an embodiment.

Substrate 74 may be mounted within the interior of lower housing 12B. FIGS. 6 and 7 are cross-sectional side views of device 10 in the vicinity of the rear edge of lower housing 12B (e.g., showing substrate 74 mounted within lower housing 12B from the direction of arrow 89 of FIG. 5). In the illustrative configurations of FIGS. 6 and 7, slot 20 between upper housing 12A and lower housing 12B (FIG. 1) includes upper and lower portions (in addition to the left and right portions 20-1 and 20-2 located at different positions along axis 22 as shown in FIG. 4). Antenna signals can pass through either the upper portion of slot 20 (shown in FIGS. 6 and 7 as upper slot 20T), through the lower portion of slot 20 (shown in FIGS. 6 and 7 as lower slot 20L), or through both upper slot 20T and lower slot 20L. With this type of arrangement, each antenna is associated with a pair of antenna apertures (i.e., the upper slot and lower slot). If desired, each antenna may operate through a single slot or through both slots.

FIG. 6 is a cross-sectional side view of device 10 in the vicinity of the rear edge of lower housing 12B when upper housing 12A is in a closed position (sometimes referred to herein as a closed lid configuration). As shown in FIG. 6, lower housing 12B may include a conductive upper wall 12B-1 and an opposing conductive lower wall 12B-2. The lateral surface of conductive upper wall 12B-1 may extend parallel or substantially parallel (e.g., within 30 degrees) to the lateral surface of conductive lower wall 12B-2. Conductive upper wall 12B-1 and conductive lower wall 12B-2 may define the interior of lower housing 12B. A main logic board, battery 36 (FIG. 2), a set of input-output devices 32, cooling system 38, transceiver circuitry 48, control circuitry 30, and other desired components may be mounted within the interior of lower housing 12B. Substrate 74 may be mounted within the interior of lower housing 12B between conductive upper wall 12B-1 and conductive lower wall 12B-2. By mounting substrate 74 in this way, an entirety of antenna resonating element 58 (FIG. 5) and substrate 74 may be interposed between conductive upper wall 12B-1 and conductive lower wall 12B-2 within the interior of lower housing 12B. This may, for example, hide antenna 40 from view of a user at the exterior of device 10 and may protect antenna 40 from contaminants or damage.

Components such as keyboard 16 and track pad 18 (FIG. 1) may operate through openings in conductive upper wall 12B-1. Conductive lower wall 12B-2, which may be joined to conductive upper wall 12B-1 around the lateral periphery of lower housing 12B (e.g., such that conductive material surrounds the interior cavity and thus substrate 74), may have feet or other support structures that allow device 10 to rest on a table top, a user's lap, or other support structure during operation. When device 10 is being used in this way, air may flow in and out of ventilation port structure 72 through openings 76 in substrate 74 (FIG. 5).

Fans and other cooling system structures (structures in cooling system 38 of FIG. 2) may be mounted within the interior of lower housing 12B (e.g., to the left of substrate 74 as shown in FIG. 6). Ventilation port structure 72 in substrate 74 may allow (intake) air to pass from the right of substrate 74 to the left of substrate 74 (e.g., as shown by arrow 86 of FIG. 5) and/or may allow (exhaust) air to pass from the left of substrate 74 to the right of substrate 74 (e.g., as shown by arrow 88 of FIG. 5).

As shown in FIG. 6, conductive upper wall 12B-1 may be electrically coupled to conductive lower wall 12B-2 using conductive structures 105. Conductive structures 105 may include sheet metal, metal foil, integral portions of lower housing 12B, conductive adhesive, solder, welds, conductive springs, conductive gaskets, conductive traces on rear surface 104 of substrate 74, and/or any other desired conductive structures. Conductive structures 105, conductive upper wall 12B-1, and conductive lower wall 12B-2 may form a conductive cavity that backs antenna 40 within lower housing 12B. Conductive structures 105 may form a rear wall of the conductive cavity (whereas conductive walls 12B-1 and 12B-2 form side walls of the conductive cavity). Conductive structures 105 may sometimes be referred to herein as rear wall 105, conductive cavity rear wall 105, conductive wall 105, or conductive shielding structure 105. Substrate 74 may extend from its front surface 82 to conductive structures 105 (e.g., the conductive cavity may be filled by substrate 74) or may only fill part of the conductive cavity. The conductive cavity may serve to enhance gain and directionality of the radio-frequency signals handled by antenna 40 (e.g., the dimensions and boundaries of the conductive cavity may be selected to direct radio-frequency signals radiated by antenna resonating element arm 60 in one or more directions with a desired gain).

Conductive structures such as structures 112 and 110 may be used to ground conductive traces on substrate 74 to lower housing 12B. Structures 112 and 110 may each include layers of conductive adhesive, conductive foam layers that help press substrate 74 upwards and/or downwards so that substrate 74 is held in place between conductive upper wall 12B-1 and conductive lower wall 12B-2, conductive gaskets (e.g., conductive gaskets formed from conductive foam, conductive fabric, a solid elastomeric conductive material, or other conductive material), conductive pins, conductive screws, solder welds, conductive wires, conductive springs, combinations of these, and/or any other desired conductive structures. Structures 112 may, for example, be used to couple grounded traces on top surface 90 of substrate 74 to conductive upper wall 12B-1 (e.g., so that conductive upper wall 12B-1 forms a part of antenna ground 56 of FIG. 3). If desired, conductive structures 112 may be coupled to conductive structures 105 (e.g., conductive structures 112 may short traces on substrate 74 to conductive lower wall 12B-2 through conductive structures 105). Structures 110 may, for example, be used to couple grounded traces on substrate 74 to conductive lower wall 12B-2 (e.g., so that conductive lower wall 12B-2 forms a part of antenna ground 56 of FIG. 3). Structures 110 and 112 may, if desired, be used to mechanically secure substrate 74 in place within lower housing 12B and/or to protect the interior of lower housing 12B from dirt or other contaminants.

Radio-frequency transmission line 50 may be coupled to antenna feed terminals 44 and 46 of antenna 40 (e.g., signal conductor 52 of transmission line 50 may be coupled to positive antenna feed terminal 44 whereas ground conductor 54 is coupled to ground antenna feed terminal 46). Signal conductor 52 and/or ground conductor 54 may be formed from a coaxial cable path that extends through an opening or cavity within substrate 74, may include conductive vias that extend through substrate 74, may include conductive traces on substrate 74, and/or may include any other desired conductive structures. Positive antenna feed terminal 44 may be coupled to antenna resonating element arm 60. Ground antenna feed terminal 46 may be coupled directly to conductive lower wall 12B-2, to grounded conductive traces on lower surface 92 of substrate 74, or to conductive structures 110, as examples. Return path 62 of antenna 40 may couple antenna resonating element arm 60 to conductive lower wall 12B-2, to grounded conductive traces on lower surface 92 of substrate 74, or to conductive structures 110. Return path 62 may include conductive traces on substrate 74, conductive wire, conductive pins, conductive vias, and/or any other desired conductive structures. If desired, antenna 40 may include a parasitic antenna resonating element such as parasitic antenna resonating element 108 (sometimes referred to herein as parasitic element 108). Parasitic element 108 may be formed on a dielectric support structure such as dielectric substrate 106.

Conductive structures 105, conductive structures 112, and/or conductive structures 110 may short conductive upper wall 12B-1 to conductive lower wall 12B-2 and may serve to electromagnetically isolate antenna 40 from components within the interior of lower housing 12B. This helps ensure that antenna signals being transmitted by antenna 40 will not interfere with circuitry in the interior of device 10 such as display circuitry for display 14, control circuitry 30, etc. Similarly, these components help ensure that operation of circuitry in the interior of device 10 does not interfere with radio-frequency operations performed by antenna 40. Conductive structures 105 may cover some or all of rear surface 104 of substrate 74 and may, if desired, have ports to accommodate air flow through openings 76 in substrate 74 (FIG. 5).

When arranged in this way, antenna resonating element arm 60 and front surface 82 of dielectric substrate 74 may face upper slot 20T and lower slot 20L so that radio-frequency antenna signals from antenna 40 may pass through upper slot 20T and lower slot 20L. Upper housing 12A may have a display portion in which display 14 is located. Display 14 and the display portion of upper housing 12A extend substantially parallel to conductive upper wall 12B-1 when upper housing 12A is in the closed position over lower housing 12B. Upper housing 12A may have a rear portion such as rear portion 114 that extends from an end of display 14. If desired, rotational axis 22 of device 10 may extend through rear portion 114 (e.g., into the page of FIG. 6). Upper housing 12A may rotate around axis 22 when moved between a closed lid position and an open lid position. Rear portion 114 of upper housing 12A has an end 94 that opposes display 14. End 94 may extend at a non-parallel angle with respect to the segment of rear portion 114 through which axis 22 passes, if desired (e.g., end 94 may form a "lip" of upper housing 12A that protrudes towards lower housing 12B).

Rear portion 114 of upper housing 12A is separated from conductive lower wall 12B-2 by lower slot 20L. As shown in FIG. 6, lower slot 20L may have a width (thickness) 98 when upper housing 12A is in the closed lid position. Width 98 may be greater than the width of upper slot 20T in the closed lid position such that the majority of the radio-frequency signals handled by antenna 40 pass through lower slot 20L, as shown by arrow 96. In practice, lower slots 20L having greater widths 98 may be more unsightly and less aesthetically pleasing than lower slots 20L having smaller widths 98. In addition, it is easier for foreign objects such as a portion of a user's clothing, a user's body, or other external objects to become lodged or stuck within lower slot 20L in scenarios where lower slot 20L has a greater width 98 than in scenarios where lower slot 20L has a smaller width 98. It may therefore be desirable to be able to provide device 10 with relatively narrow lower slots 20L.

In order to minimize the width 98 of lower slot 20L, conductive lower wall 12B-2 may include a protruding portion 100 (sometimes referred to herein as protruding lip 100, lip 100, shelf 100, ledge 100, or extension 100). Protruding portion 100 may extend beyond front surface 82 of substrate 74 by length 102 (e.g., protruding portion 100 may have a length 102 and substrate 74 may be separated from lower slot 20L by length 102). In other words, substrate 74 may be recessed within lower housing 12B by length 102. As examples, width 98 may be between 2.0 and 2.5 mm, between 2.2 and 2.3 mm, between 1.5 and 3.0 mm, between 1.0 mm and 4.0 mm, less than 5 mm, less than 5.3 mm, between 0.5 mm and 5.3 mm, etc. Length 102 may be between 1.0 mm and 2.0 mm, between 2.0 mm and 3.0 mm, between 1.0 mm and 3.0 mm, between 0.5 mm and 4.0 mm, between 0.25 mm and 5.0 mm, or any other desired length. When configured in this way, lower slot 20L may have a satisfactory width for optimizing the aesthetic appearance of device 10 and minimizing the risk of foreign objects becoming stuck within lower slot 20L.

At the same time, if care is not taken, recessing substrate 74 into lower housing 12B and constraining width 98 of lower slot 20L can make it more difficult to convey radio-frequency signals between antenna 40 and external wireless equipment via lower slot 20L. This can serve to limit the overall antenna efficiency of antenna 40, particularly in scenarios where antenna 40 covers multiple frequency bands. For example, if care is not taken, the antenna may exhibit satisfactory antenna efficiency within a 5.0 GHz frequency band while exhibiting unsatisfactory antenna efficiency within a 2.4 GHz frequency band. In another possible arrangement, ground antenna feed terminal 46 and return path 62 of antenna 40 may be coupled to conductive upper wall 12B-1 instead of conductive lower wall 12B-2. However, in this scenario, the antenna may exhibit satisfactory antenna efficiency within the 2.4 GHz frequency band while exhibiting unsatisfactory antenna efficiency within the 5.0 GHz frequency band.

Coupling the feed for antenna 40 and return path 62 to conductive lower wall 12B-2 (as shown in FIG. 6) may serve to optimize transmission and reception through lower slot 20L in the 5.0 GHz frequency band. In particular, grounding antenna 40 in this way may shift current hot spots in the 5.0 GHz frequency band towards conductive lower wall 12B-2, thereby pushing the electric field distribution of antenna 40 in the 5.0 GHz frequency band closer to the location of lower slot 20L and allowing lower slot 20L to pass a satisfactory amount of radio-frequency signals in the 5.0 GHz frequency band. In order to recover wireless performance in the lower 2.4 GHz frequency band, antenna resonating element arm 60 may be mounted within lower housing 12B so that it is separated from conductive structures 105 by a selected distance 116 (sometimes referred to herein as cavity depth 116 or cavity thickness 116 of the conductive cavity backing antenna resonating element arm 60). In general, larger cavity depths 116 may allow for greater antenna efficiency within the 2.4 GHz frequency band than shallower cavity depths (while also consuming greater volume within device 10). In this way, some of the volume within lower housing 12B that would otherwise be available to other device components may be sacrificed in order to increase cavity depth 116 to a level that supports satisfactory antenna efficiency in the 2.4 GHz frequency band.

In order to support satisfactory antenna efficiency in the 2.4 GHz frequency band, cavity depth 116 may be selected to be at least one-sixteenth of the wavelength of operation of antenna 40 (e.g., an effective wavelength corresponding to a frequency in the 2.4 GHz frequency band when offset to compensate for the dielectric constant of substrate 74). If desired, antenna performance in the 2.4 GHz frequency band may be balanced with volume consumption in device 10 by selecting cavity depth 116 to be between one-sixteenth and one-half of the wavelength of operation of antenna 40, between one-half and three-quarters of the wavelength of operation, between one-half and one-quarter of the wavelength of operation, between one-sixteenth and one-quarter of the wavelength of operation, approximately equal to (e.g., within 15% of) one-eighth of the wavelength of operation, or approximately equal to one-quarter of the wavelength of operation, as examples (e.g., between 5 and 15 mm, between 10 and 12 mm, between 24 and 30 mm, between 20 and 40 mm, between 5 and 20 mm, between 3 and 35 mm, etc.). Substrate 74 may have a thickness (extending from front surface 82 to rear surface 104) that is approximately equal to cavity depth 116 or may have a thickness that is less than cavity depth 116 (e.g., in scenarios where substrate 74 does not extend all the way to conductive structures 105). In this way, antenna 40 may convey radio-frequency signals through lower slot 20L while upper housing 12A is in the closed lid position with satisfactory antenna efficiency in both relatively low and relatively high frequency bands such as the 2.4 GHz and the 5.0 GHz frequency bands.

FIG. 7 shows device 10 in an illustrative lid-open configuration in which upper housing 12A has been rotated into an open position about rotational axis 22. In practice, varying the position of upper housing 12A with respect to lower housing 12B may alter the widths of upper slot 20T and lower slot 20L. As shown in FIG. 7, upper slot 20T has a greater width when upper housing 12A is in the open position than when it is in the closed position (FIG. 6). At the same time, lower slot 20L may have a width 119 when upper housing 12A is in the open position. Width 119 may be even smaller than width 98 of FIG. 6. This decrease in lower slot width may have little or no effect on antenna performance in the 5.0 GHz frequency band. Antenna 40 may therefore convey radio-frequency signals in the 5.0 GHz frequency band through lower slot 20L and/or upper slot 20T regardless of the position of upper housing 12A. However, opening upper housing 12A (i.e., shortening the width of lower slot 20L) reduces the amount of radio-frequency energy that can be conveyed through lower slot 20L in the 2.4 GHz frequency band. If care is not taken, this can deteriorate antenna efficiency in the 2.4 GHz frequency band to potentially unsatisfactory levels when upper housing 12A is in the open position.

In order to mitigate this deterioration in 2.4 GHz performance, parasitic element 108 may be coupled to conductive upper wall 12B-1 of lower housing 12B. Parasitic element 108 may, for example, be formed on a dielectric support structure such as substrate 106 that is mounted to conductive upper wall 12B-1 at or adjacent to upper slot 20T. Substrate 106 may include plastic, ceramic, adhesive, combinations of these, and/or any other desired dielectric materials. Parasitic element 108 may be formed from conductive traces on substrate 106, a sheet metal member, metal foil, an integral portion of conductive upper wall 12B-1, or any other desired conductive structures.

Parasitic element 108 may have a length that is selected so that parasitic element 108 resonates in the lower frequency band covered by antenna 40 (e.g., in the 2.4 GHz frequency band). In this way, parasitic element 108 may strengthen the electromagnetic field associated with antenna 40 at the location of upper slot 20T, effectively shifting radiation in the 2.4 GHz frequency band from lower slot 20L towards and through upper slot 20T (as shown by arrow 120). In other words, parasitic element 108 may effectively redirect radio-frequency energy that would otherwise be radiated towards lower slot 20L through upper slot 20T instead. This may serve to increase antenna efficiency in the 2.4 GHz band to satisfactory levels when upper housing 12A is in the open position.

The example of FIG. 7 is merely illustrative. In general, parasitic element 108 may be coupled to conductive upper wall 12B-1 at any desired location between substrate 74 and upper slot 20T (e.g., parasitic element 108 may be interposed between arm 60 and upper slot 20T or between substrate 74 and upper slot 20T). If desired, substrate 106 and substrate 74 may be formed from a single integral dielectric substrate (e.g., parasitic element 108 may be formed on an extension of dielectric substrate 74). Parasitic element 108 may be coupled to other support structures (e.g., support structures that are not mounted to conductive upper wall 12B-1) or may be formed without any dielectric support structures if desired. Dielectric substrate 106 may be used to support other device components such as flexible printed circuit 64 of FIG. 4 if desired.

Figure 8:
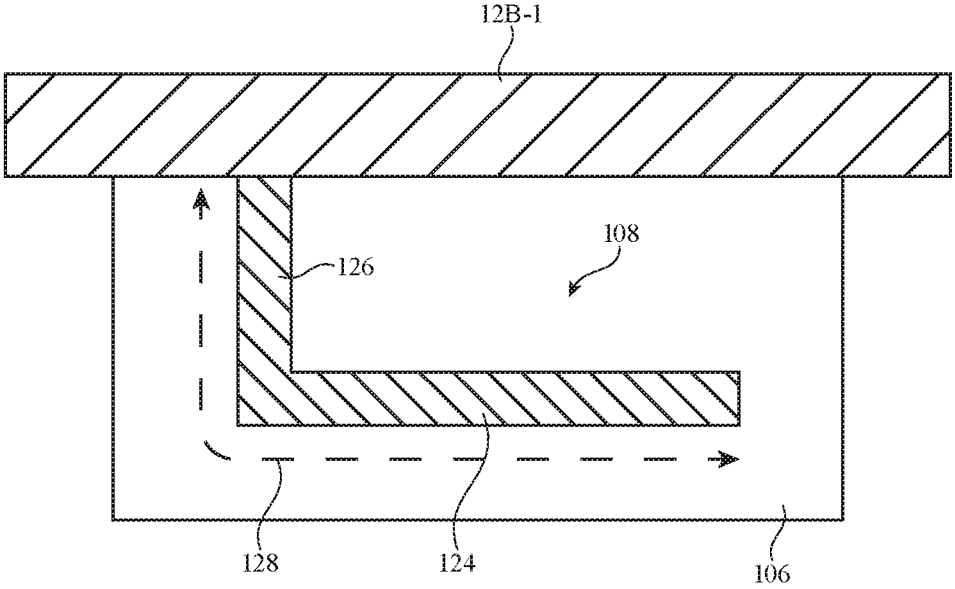
FIG. 8 is a side view of an illustrative parasitic antenna resonating element that may be formed in antenna structures of the type shown in FIGS. 6 and 7 in accordance with an embodiment.

FIG. 8 is a front view of parasitic element 108 mounted within lower housing 12B of device 10 (e.g., as taken in the direction of arrow 122 of FIG. 7). As shown in FIG. 8, parasitic element 108 may include one or more conductive arms such as arms 126 and 124 on substrate 106. Arm 126 may be coupled to conductive upper wall 12B-1. For example, arm 126 (sometimes referred to herein as short path or return path 126) may be coupled to conductive upper wall 12B-1 using solder, welds, conductive adhesive, or other materials. In another suitable arrangement, arm 126 and arm 124 are formed from an integral extension of conductive upper wall 12B-1.

Arm 124 may extend from the end of arm 126 (e.g., in a non-parallel direction with respect to the longitudinal axis of arm 126). Parasitic element 108 may have a length 128 (e.g., from the base of arm 126 at conductive upper wall 12B-1 to the opposing tip of arm 124). Length 128 may be selected to be approximately equal to (e.g., within 15% of) one-quarter of a wavelength of operation of antenna 40 (e.g., a wavelength corresponding to a frequency in a relatively low frequency band such as the 2.4 GHz frequency band). This length may be adjusted to compensate for the dielectric constant of substrate 106 if desired. This length may be tweaked to adjust the amount of radio-frequency energy in the 2.4 GHz frequency band that is redirected from lower slot 20L towards and through upper slot 20T (FIG. 7).

In the example of FIG. 8, parasitic element 108 is an "L-shaped" parasitic element, with arm 126 extending perpendicular to arm 124 (e.g., where arm 124 extends parallel to the lateral surface of conductive upper wall 12B-1). This is merely illustrative and, in general, parasitic element 108 may have any desired shape (e.g., any desired shape having curved and/or straight edges and following any desired path such as a meandering path or paths having curved and/or straight segments). Parasitic element 108 may include any desired number of arms or branches. If desired, antenna 40 may include multiple parasitic elements 108 on substrate 106.

Figure 9:
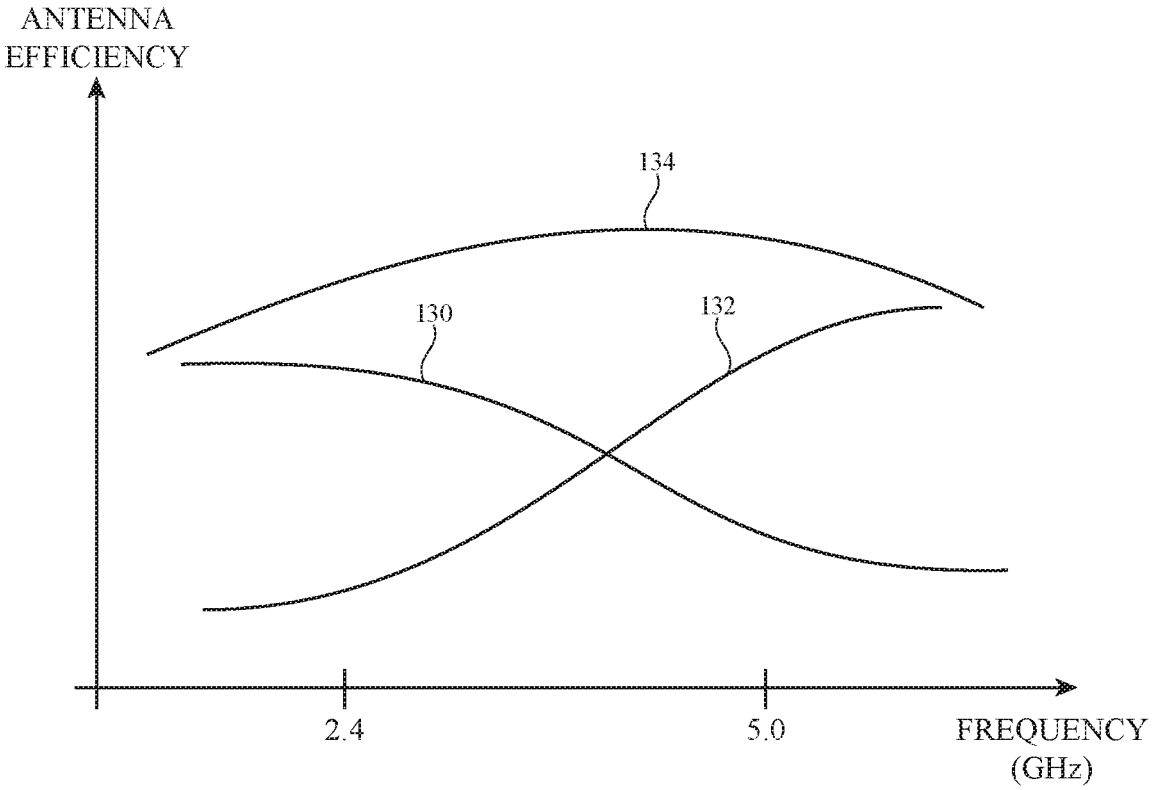
FIG. 9 is a graph in which antenna performance (antenna efficiency) has been plotted as a function of frequency for a laptop computer placed in a closed lid configuration in accordance with an embodiment.

In the illustrative graph of FIG. 9, antenna efficiency has been plotted as a function of frequency for scenarios in which upper housing 12A is placed in the closed position (e.g., as shown in FIG. 6). Curve 130 corresponds to an antenna arrangement in which ground antenna feed terminal 46 and return path 62 are connected to conductive upper wall 12B-1 instead of conductive lower wall 12B-2. As shown by curve 130, forming the antenna in this way allows for a relatively high antenna efficiency in a low frequency band such as the 2.4 GHz frequency band while exhibiting a relatively low (e.g., unsatisfactory) antenna efficiency in a relatively high band such as the 5.0 GHz frequency band.

Curve 132 corresponds to an antenna arrangement in which ground antenna feed terminal 46 and return path 62 are coupled to conductive lower wall 12B-2, but where the conductive cavity formed by conductive structures 105 has insufficient cavity depth (e.g., where cavity depth 116 of FIG. 6 is less than one-sixteenth of the wavelength corresponding to a frequency in the 2.4 GHz frequency band). As shown by curve 132, forming the antenna in this way allows for a relatively high antenna efficiency in the 5.0 GHz frequency band while exhibiting a relatively low (e.g., unsatisfactory) antenna efficiency in the 5.0 GHz frequency band.

Curve 134 corresponds to the antenna arrangement shown in FIG. 6 (e.g., where ground antenna feed terminal 46 and return path 62 are coupled to conductive lower wall 12B-2 and where antenna 40 is provided with a sufficiently large cavity depth 116). As shown by curve 134 of FIG. 9, forming the antenna in this way allows for a relatively high antenna efficiency in both the 5.0 GHz frequency band and the 2.4 GHz frequency band through lower slot 20L while upper housing 12A is in the closed position.

Figure 10:
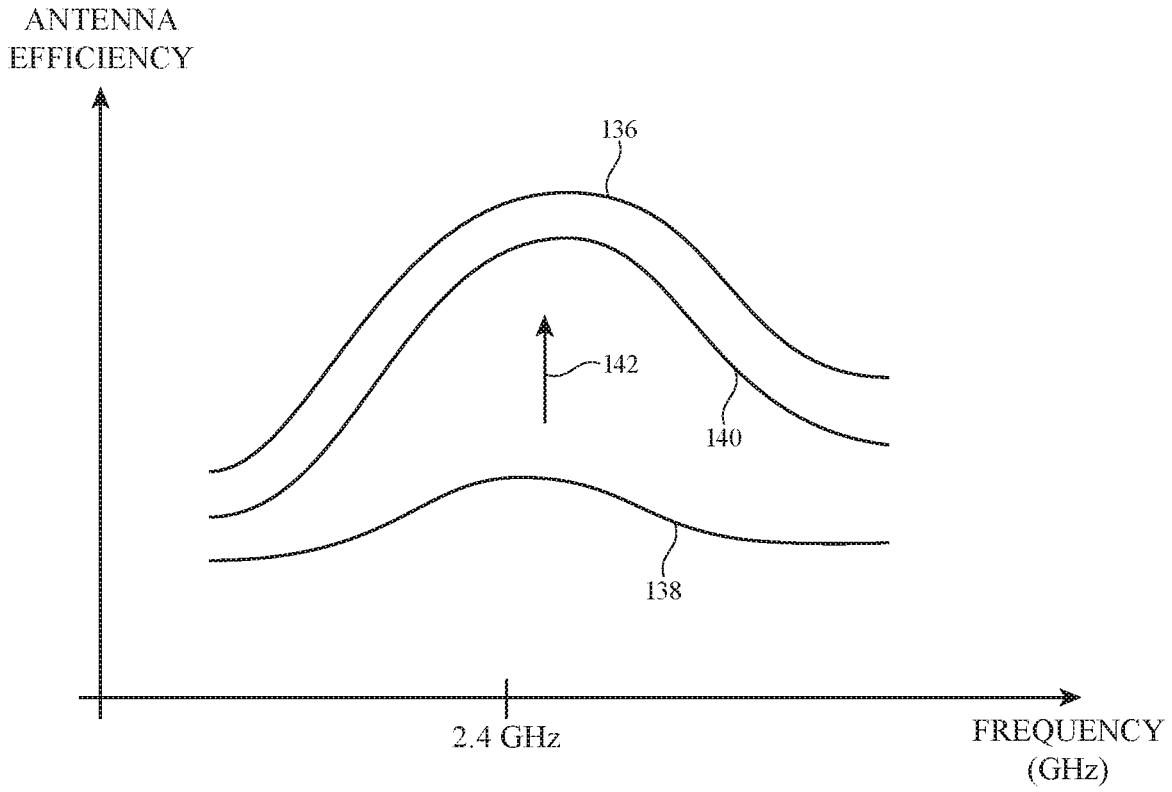
FIG. 10 is a graph in which antenna performance (antenna efficiency) has been plotted as a function of frequency for a laptop computer placed in an open lid configuration in accordance with an embodiment.

In the illustrative graph of FIG. 10, antenna efficiency has been plotted as a function of frequency for scenarios in which upper housing 12A is placed in the open position (e.g., as shown in FIG. 7). Curve 136 corresponds to an antenna arrangement in which parasitic 108 and protruding portion 100 of conductive lower wall 12B-2 are omitted. In this arrangement, slot 20L is provided with a relatively large width such as 5.0 mm or greater and the surface of substrate 74 is located adjacent to slots 20T and 20L. As shown by curve 136, forming the antenna in this way allows for a relatively high antenna efficiency in a low frequency band such as the 2.4 GHz frequency band.

Curve 138 corresponds to an antenna arrangement of the type shown in FIG. 7 but where parasitic element 108 has been omitted. In this arrangement, slot 20L is provided with a relatively narrow width 98, thereby optimizing the aesthetic appearance of device 10 and minimizing the risk of a foreign object becoming lodged in slot 20L. As shown by curve 138, forming the antenna in this way reduces the antenna efficiency in the 2.4 GHz band to a relatively low level (e.g., an unsatisfactory level that is less than a predetermined threshold value). This antenna efficiency may be insufficient for conveying wireless data over the 2.4 GHz frequency band without generating an undesirable number of errors in the wireless data, for example.

Curve 140 corresponds to an antenna arrangement of the type shown in FIG. 7 (e.g., including parasitic element 108). In this arrangement, lower slot 20L is provided with a relatively narrow width 98, thereby optimizing the aesthetic appearance of device 10 and minimizing the risk of a foreign object becoming lodged in lower slot 20L. Parasitic element 108 may serve to redirect radio-frequency electromagnetic energy in the 2.4 GHz band from the region adjacent to lower slot 20L towards and through upper slot 20T (FIG. 7). As shown by arrow 142 of FIG. 10, forming the antenna in this way boosts the antenna efficiency in the 2.4 GHz band to a satisfactory level while upper housing 12A is in the open position. Curve 140 may have a peak magnitude that is equal to or within an acceptable margin of curve 136.

The example of FIG. 10 only shows antenna performance in the 2.4 GHz frequency band for the sake of clarity. Curves 138, 140, and 136 may extend into the 5.0 GHz frequency band. In practice, curves 138, 140, and 136 may exhibit satisfactory antenna efficiency in the 5.0 GHz frequency band. The examples of FIGS. 9 and 10 are merely illustrative. In practice, curves 130, 132, and 134 of FIG. 9 and curves 138, 140, and 136 of FIG. 10 may have different shapes (e.g., curve 134 of FIG. 9 and curve 140 of FIG. 10 may extend across any desired frequencies). Antenna 40 may exhibit any desired number of response peaks in any desired frequency bands. The 2.4 GHz frequency band may include any desired WLAN and/or WPAN frequency bands at frequencies between 2.4 GHz and 2.5 GHz, for example. The 5.0 GHz frequency band may include any desired WLAN frequency bands at frequencies between 4.9 GHz and 5.9 GHz, for example.

In this way, antenna 40 may operate with satisfactory antenna efficiency across two or more frequency bands (e.g., a low frequency band such as the 2.4 GHz frequency band and a high frequency band such as the 5.0 GHz frequency band) regardless of whether upper housing 12A is in the open, the closed position, or an intermediate position between the open and closed positions. At the same time, the width of lower slot 20L may be sufficiently narrow so as to optimize the aesthetic appearance of device 10 and to minimize the risk of foreign objects becoming lodged or pinched within lower slot 20L, for example.

Figure 11:
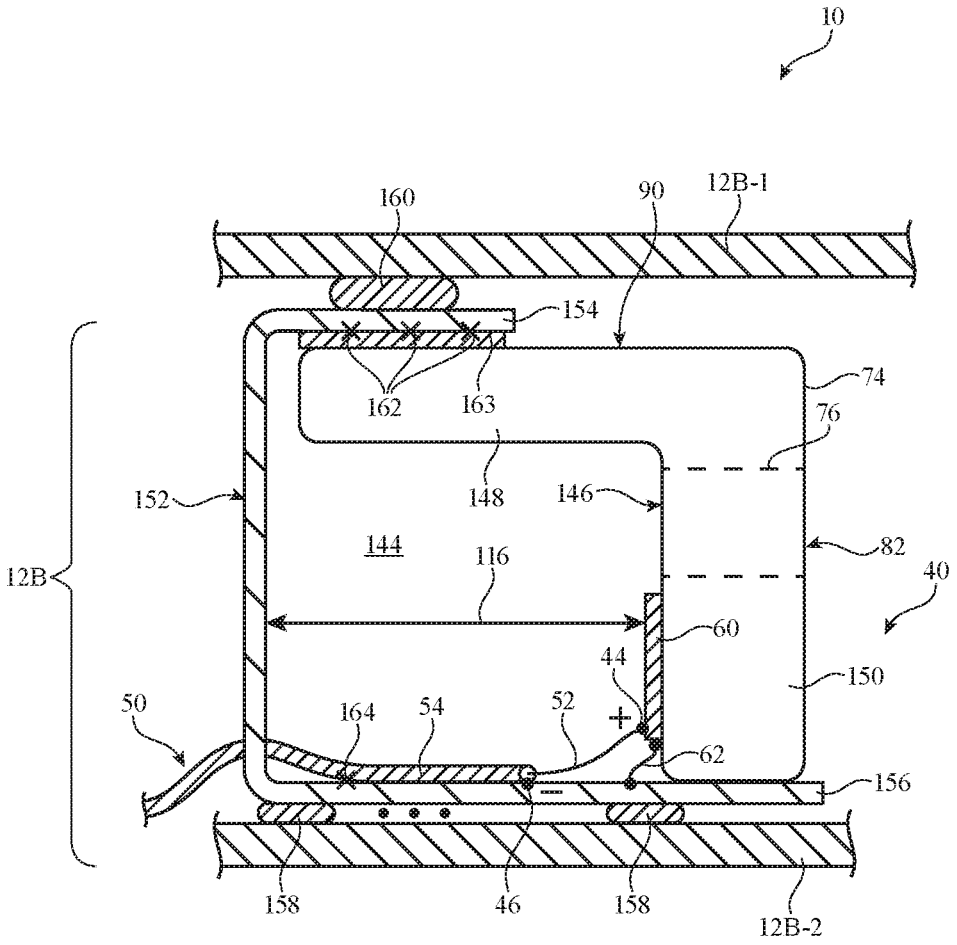
FIG. 11 is a cross-sectional side view of a dielectric substrate that supports an antenna resonating element mounted between conductive housing walls of an electronic device in accordance with an embodiment.

FIG. 11 is a cross-sectional side view of structures that may be used in mounting antenna 40 between conductive walls 12B-1 and 12B-2 of lower housing 12B (e.g., as viewed in the same direction as FIGS. 6 and 7 and from the direction of arrow 89 of FIG. 5). As shown in FIG. 11, substrate 74 may include a cavity 144. For example, substrate 74 may have an "L-shape" with a horizontal portion 148 extending from an end of vertical portion 150. Ventilation port openings 76 may extend through vertical portion 150 (e.g., from front surface 82 to inner surface 146 of substrate 74).

Radio-frequency transmission line 50 (e.g., a coaxial cable or other transmission line) may extend into the cavity 144 defined by substrate 74. Conductive structures 105 of FIGS. 6 and 7 may be formed using conductive gasket 160, sheet metal member 152, and conductive gasket 158. Sheet metal member 152 may be folded around substrate 74 and cavity 144 (e.g., the edges of cavity 144 may be defined by sheet metal member 152 and substrate 74). For example, sheet metal member 152 may have a first end 154 interposed between horizontal portion 148 of substrate 74 and conductive upper wall 12B-1. Sheet metal member 152 may have a second end 156 extending between substrate 74 and conductive lower wall 12B-2. Second end 156 of sheet metal member 152 may extend across the length of cavity 144 and may, if desired, extend under vertical portion 150 of substrate 74.

End 154 of sheet metal member 152 may be coupled to conductive traces 163 on top surface 90 of substrate 74 using welds or solder 162. End 154 of sheet metal member 152 may be coupled to conductive upper wall 12B-1 by one or more conductive gaskets 160. Conductive gasket 160 may be used in forming conductive structures 112 and part of conductive structures 105 of FIGS. 6 and 7, for example. Conductive gasket 160 may bias substrate 74 downwards towards conductive lower wall 12B-2 to help hold substrate 74 in place and/or may be adhesive. Coupling sheet metal member 152 to traces 163 may serve to mechanically secure or affix substrate 74 in place, for example.

End 156 of sheet metal member 152 may be coupled to conductive lower wall 12B-2 using one or more conductive gaskets 158. Conductive gasket 158 may be used in forming conductive structures 110 and part of conductive structures 105 of FIGS. 6 and 7, for example. Conductive gasket 158 may bias substrate 74 upwards towards conductive upper wall 12B-1 to help hold substrate 74 in place and/or may be adhesive.

Ground conductor 54 of transmission line 50 may be coupled to sheet metal member 152 at ground antenna feed terminal 46. If desired, ground conductor 54 may be coupled to sheet metal member 152 at other locations such as locations 164 (e.g., using solder or welds). In the example of FIG. 11, antenna resonating element arm 60 is formed from conductive traces on inner surface 146 of substrate 74. Signal conductor 52 of transmission line 50 may be coupled to positive antenna feed terminal 44 on antenna resonating element arm 60. Antenna resonating element arm 60 may be coupled to sheet metal member 152 over return path 62. In another suitable arrangement, antenna resonating element arm 60 may be formed on front surface 82 of substrate 74. In this scenario, return path 62 and/or signal conductor 52 may include conductive vias extending through vertical portion 150 of substrate 74 or may extend through openings in vertical portion 150 of substrate 74. Antenna resonating element arm 60 may be located at cavity depth 116 from sheet metal member 152. Forming antenna resonating element arm 60 on inner surface 146 may protect the antenna resonating element arm from damage or contaminants, for example.

When configured in this way, conductive upper wall 12B-1, conductive lower wall 12B-2, conductive gasket 160, conductive gasket 158, sheet metal member 152, and/or conductive traces 163 may define the conductive cavity backing the antenna resonating element of antenna 40 while also serving to secure the antenna resonating element in place within lower housing 12B. The example of FIG. 11 is merely illustrative. In general, substrate 74 and sheet metal member 152 may have any desired shape. Any desired conductive components may be used in forming the conductive cavity for antenna 40.

The foregoing is merely illustrative and various modifications can be made by those skilled in the art without departing from the scope and spirit of the described embodiments. The foregoing embodiments may be implemented individually or in any combination.

What is claimed is:

1. A portable computer, comprising:

a housing having an upper housing portion that contains a display and having a lower housing portion, wherein the lower housing portion has opposing first and second conductive walls;

hinges that connect the upper housing portion to the lower housing portion, wherein the upper housing portion is configured to rotate relative to the lower housing portion between an open position and a closed position, and the upper housing portion is separated from the first conductive wall by a slot when the upper housing portion is in the open position; and an antenna configured to transmit and receive radio-frequency signals through the slot, wherein the antenna comprises:

an antenna resonating element mounted within the lower housing portion between the first and second conductive walls, and a parasitic element mounted within the lower housing portion between the antenna resonating element and the slot.

2. The portable computer defined in claim 1, further comprising:

a dielectric support structure mounted within the lower housing portion, wherein the antenna resonating element comprises conductive traces on the dielectric support structure.

3. The portable computer defined in claim 2, further comprising:

an additional dielectric support structure mounted to the first conductive wall, wherein the parasitic element comprises conductive traces on the additional dielectric support structure.

4. The portable computer defined in claim 3, wherein the antenna is configured to transmit and receive the radio-frequency signals in a first frequency band and a second frequency band that is higher than the first frequency band, and the parasitic element is configured to resonate at frequencies in the first frequency band.

5. The portable computer defined in claim 4, wherein the parasitic element comprises an arm and a short circuit path that couples an end of the arm to the first conductive wall.

6. The portable computer defined in claim 4, wherein the first frequency band comprises frequencies between 2.4 GHz and 2.5 GHz and the second frequency band comprises frequencies between 4.9 GHz and 5.9 GHz.

7. The portable computer defined in claim 2, further comprising:

conductive structures that couple the first conductive wall to the second conductive wall and that define a rear wall of a conductive cavity backing the antenna resonating element.

8. The portable computer defined in claim 7, wherein the conductive structures comprise:

a sheet metal member;

a first conductive gasket that couples the sheet metal member to the first conductive wall; and a second conductive gasket that couples the sheet metal member to the second conductive wall, wherein the dielectric substrate comprises an interior cavity having a first edge defined by the sheet metal member and a second edge defined by the dielectric substrate, an entirety of the conductive traces being formed at the second edge of the interior cavity.

9. The portable computer defined in claim 2, wherein the dielectric substrate comprises ventilation port openings that serve as airflow passageways for a cooling system in the lower housing portion.

10. The portable computer defined in claim 2, wherein the upper housing portion is separated from the second conductive wall by an additional slot when the upper housing portion is in the closed position and the antenna is configured to transmit and receive the radio-frequency signals through the additional slot when the upper housing is in the closed position.

11. The portable computer defined in claim 10, wherein the second conductive wall comprises a lip that extends beyond the dielectric support structure and that defines an edge of the additional slot.

12. The portable computer defined in claim 11, wherein the antenna further comprises:

a positive antenna feed terminal coupled to the antenna resonating element and a ground antenna feed terminal coupled to the second conductive wall; and a return path coupled between the antenna resonating element and the second conductive wall.

13. The portable computer defined in claim 12, further comprising:

conductive structures that couple the first conductive wall to the second conductive wall and that define a rear wall of a conductive cavity, wherein the antenna resonating element is backed by the conductive cavity, the antenna is configured to transmit and receive the radio-frequency signals in a given frequency band through the additional slot when the upper housing portion is in the closed position, and the rear wall is located at a cavity depth from the antenna resonating element, the cavity depth being at least one-sixteenth of a wavelength corresponding to a frequency in the given frequency band.

14. A portable computer comprising:

a metal housing having an upper housing portion that contains a display and having a lower housing portion, wherein the lower housing portion has opposing first and second conductive walls;

hinges that connect the upper housing portion to the lower housing portion, wherein the upper housing portion is configured to rotate relative to the lower housing portion between an open position and a closed position, and the upper housing portion is separated from the second conductive wall by a slot when the upper housing portion is in the closed position;

conductive structures in the lower housing portion that short the first conductive wall to the second conductive wall;

a dielectric substrate that is mounted within the lower housing portion and that is located between the conductive structures and the slot; and an antenna resonating element on the dielectric substrate and interposed between the first and second conductive walls, wherein the antenna resonating element is configured to convey radio-frequency signals in a given frequency band through the slot when the upper housing portion is in the closed position, the antenna resonating element is located at a given distance from the conductive structures, and the given distance is at least one-sixteenth of a wavelength corresponding to a frequency in the given frequency band.

15. The portable computer defined in claim 14, wherein the given distance is between one-sixteenth and one-quarter of the wavelength.

16. The portable computer defined in claim 15, wherein the antenna resonating element is configured to convey the radio-frequency signals in an additional frequency band that is higher than the given frequency band through the slot when the upper housing portion is in the closed position.

17. The portable computer defined in claim 16, wherein the second conductive wall comprises a protruding portion that extends beyond an edge of the dielectric substrate and that defines an edge of the slot, further comprising:

a ground antenna feed terminal coupled to the second conductive wall;

a positive antenna feed terminal coupled to the antenna resonating element;

a return path coupled between the antenna resonating element and the second conductive wall;

radio-frequency transceiver circuitry; and a radio-frequency transmission line that couples the radio-frequency transceiver circuitry to the positive antenna feed terminal and the ground antenna feed terminal.

18. A portable computer comprising:

a metal base housing containing a keyboard, wherein the metal base housing comprises first and second conductive walls;

a metal lid containing a display;

hinges that couple the metal lid to the metal base housing, wherein the metal lid is separated from the first conductive wall by an upper slot and is separated from the second conductive wall by a lower slot;

an antenna resonating element that is mounted within the metal base housing between the first and second conductive walls and that is configured to transmit radio-frequency signals through the lower slot; and a parasitic antenna resonating element that is configured to redirect at least some of the transmitted radio-frequency signals through the upper slot.

19. The portable computer defined in claim 18, wherein the transmitted radio-frequency signals comprise radio-frequency signals in a 2.4 GHz wireless local area network (WLAN) frequency band, and the antenna resonating element is further configured to transmit additional radio-frequency signals through the upper and lower slots in a 5 GHz WLAN frequency band.

20. The portable computer defined in claim 19, wherein the parasitic antenna resonating element is mounted to the first conductive wall and comprises a conductive arm that is configured to resonate at frequencies in the 2.4 GHz WLAN frequency band.

* * * * *